US006756573B2

(12) United States Patent
Cornell

(10) Patent No.: US 6,756,573 B2
(45) Date of Patent: Jun. 29, 2004

(54) HEATED GOLF CLUB GRIP

(76) Inventor: Jeffrey Cornell, R.R. 3 Box 13, Wellsboro, PA (US) 16901

( * ) Notice: Subject to any disclaimer, the term of this patent is extended or adjusted under 35 U.S.C. 154(b) by 0 days.

(21) Appl. No.: 10/444,889

(22) Filed: May 23, 2003

(65) Prior Publication Data

US 2003/0218007 A1 Nov. 27, 2003

Related U.S. Application Data

(60) Provisional application No. 60/382,775, filed on May 23, 2002.

(51) Int. Cl.[7] ..... H05B 3/00

(52) U.S. Cl. ..... 219/541; 219/521; 219/207

(58) Field of Search ..... 219/207, 221, 219/227, 240, 246, 247, 520, 521, 525, 538, 541

(56) References Cited

U.S. PATENT DOCUMENTS

| | | | | |
|---|---|---|---|---|
| 4,524,973 A | | 6/1985 | Sterbik | |
| 4,584,787 A | | 4/1986 | Aho | |
| 4,598,192 A | | 7/1986 | Garrett | |
| 4,600,195 A | | 7/1986 | Hunter | |
| 4,646,461 A | | 3/1987 | McLeod | |
| 5,124,532 A | * | 6/1992 | Hafey et al. | 219/200 |
| 5,341,927 A | | 8/1994 | Coyner | |
| 5,413,339 A | | 5/1995 | Martin | |
| 5,517,786 A | | 5/1996 | Peissig | |
| 5,575,721 A | | 11/1996 | Lilly | |
| 5,585,026 A | | 12/1996 | Smith | |
| 5,655,328 A | | 8/1997 | Childs | |
| 5,834,738 A | | 11/1998 | Wilson | |
| 5,934,267 A | | 8/1999 | Briner | |
| 6,273,083 B1 | | 8/2001 | Leja | |
| 6,326,884 B1 | | 12/2001 | Wohlrabe | |

* cited by examiner

*Primary Examiner*—Thor Campbell
(74) *Attorney, Agent, or Firm*—Gardner Groff, P.C.

(57) ABSTRACT

A heating system for warming and drying the grip of a golf club includes an electric heating element and a first electrical connector for the grip, and a second electrical connector and a power supply for the golf bag. The first electrical connector and the second electrical connector electrically engage when the golf club is inserted into the golf bag, thereby energizing the electric heating element.

36 Claims, 7 Drawing Sheets

FIG. 6

FIG. 11
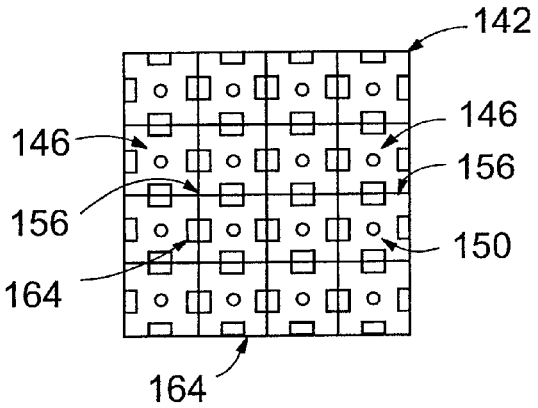
FIG. 13
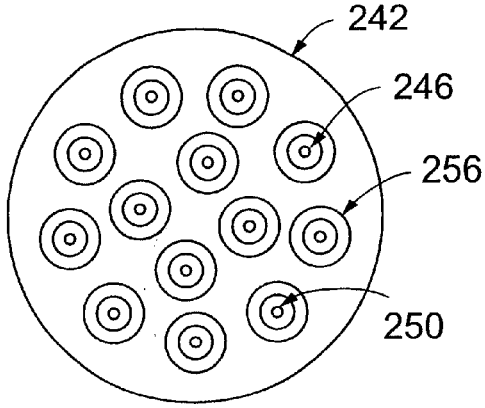
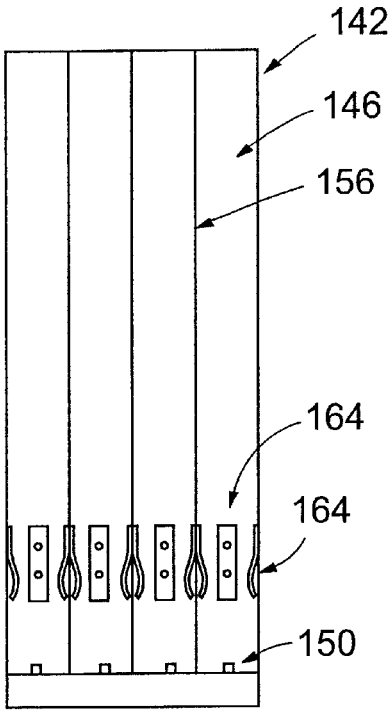
FIG. 10
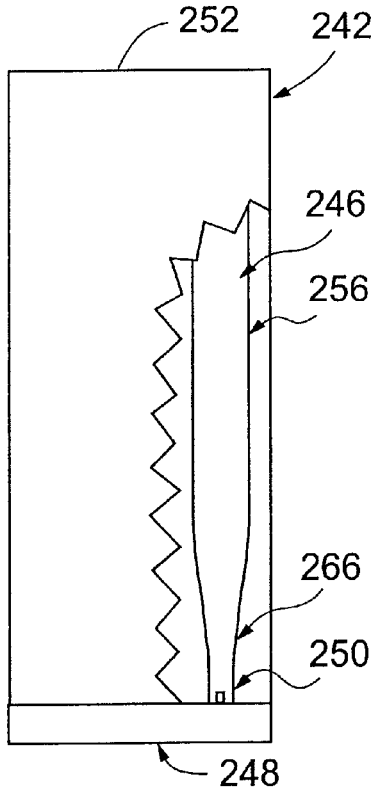
FIG. 12

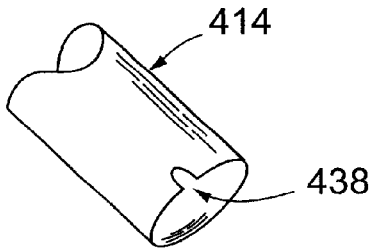
FIG. 15
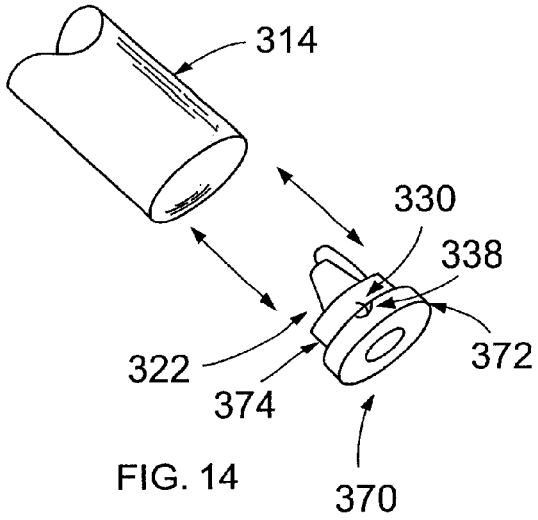
FIG. 14
FIG. 17
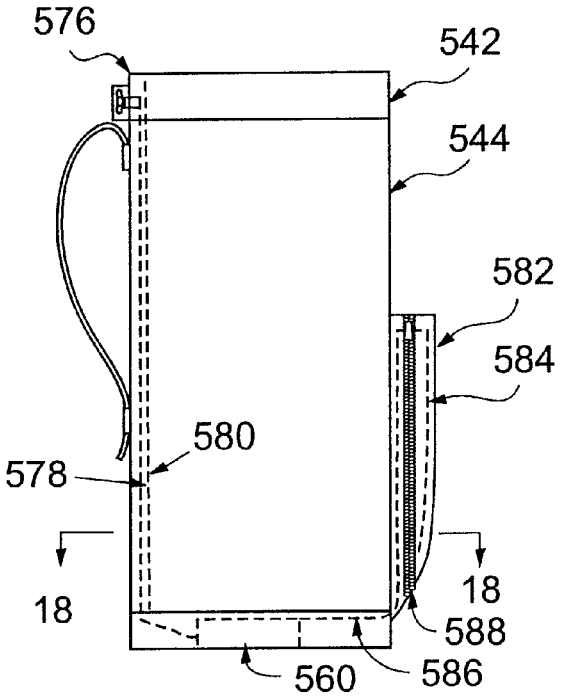
FIG. 16
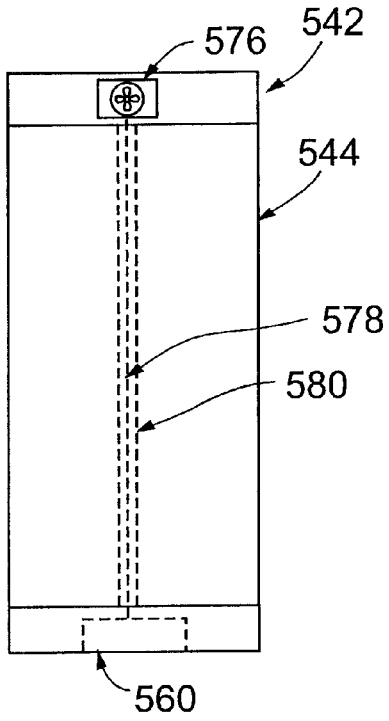
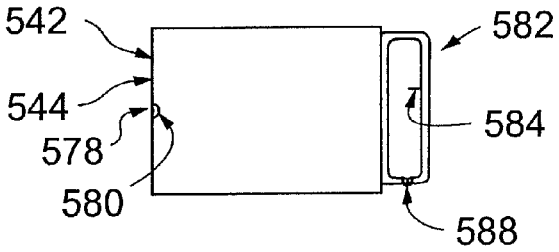
FIG. 18

HEATED GOLF CLUB GRIP

CROSS-REFERENCE TO RELATED APPLICATION

This application claims the priority benefit of U.S. Provisional Patent Application No. 60/382,775, filed May 23, 2002, which is hereby incorporated by reference in its entirety.

TECHNICAL FIELD

The present invention relates generally to golf equipment and, in particular, to heating grips on golf clubs to help keep the grips warm and dry when playing in cold and/or wet conditions.

BACKGROUND OF THE INVENTION

Golfers sometimes play the game in cold and/or wet weather conditions. This is common for avid golfers who play early and late in the golfing season, for any players during morning dew conditions, and for any players when the weather turns bad during or just before starting a round. And this is particularly common for golfers playing in geographic regions where the golfing season is short and/or where weather conditions are often less conducive to playing the game.

When playing in cold and/or wet conditions, it is more difficult to play the game well. The clubs and the player's hands become cold, causing the player to have less "feel" of his clubs. And the clubs and the player's hands become wet and slippery, so the player cannot get a good grip on his clubs. Under these conditions, players tend to score higher and experience less enjoyment from playing golf. Or they just do not play or do not complete their round.

Accordingly, there is a need for a heating system for golf club grips that keeps the grips warm and dry when playing in cold and/or wet weather conditions. Furthermore, there is a need for such a heating system that can be easily and cost-effectively used with a player's new or existing golf clubs. It is primarily to the provision of such a heating system for golf club grips that the present invention is directed.

SUMMARY OF THE INVENTION

Briefly described, in a preferred form the present invention comprises a heating system for warming and drying the grip of a golf club. The heating system includes a heater assembly having an electric heating element and a first electrical connector for the golf club grip. In addition, the heating system includes a second electrical connector and a power supply for the golf bag. The first electrical connector and the second electrical connector electrically engage when the golf club is inserted into the golf bag. When the first and second electrical connectors are electrically engaged, the power supply energizes the electric heating element.

In a first exemplary embodiment, the electric heating element is provided by an electric resistance heat strip that is formed into an adhesive-backed tape that is wrapped around the golf club shaft, and the grip is installed over the tape. The first electrical connector has at least one contact and a receptacle that are mounted to the grip or the shaft. The receptacle is preferably tapered for guiding a second electrical connector into electrical engagement with the first electrical connector.

The second electrical connector is mounted to a base of the golf bag or elsewhere and within a dedicated compartment formed by divider walls in the golf bag. The second electrical connector has at least one contact that is electrically connected to the power supply, which is preferably provided by one or more batteries mounted in the base or elsewhere in the golf bag. And a control system is mounted in the base or elsewhere in the golf bag for turning the power supply on and off, controlling the temperature and/or heating cycle, etc.

In a second exemplary embodiment of the present invention, the compartments of the golf club bag include guides mounted to the divider walls to urge the golf clubs into alignment with the corresponding second electrical connectors.

In a third exemplary embodiment, the compartments of the golf club bag have divider walls that are tapered to form smaller cross-sectional compartments adjacent the bag base than at the bag top to urge to the golf clubs into alignment with the corresponding second electrical connectors.

In a fourth exemplary embodiment, the heater assembly includes an end cap for coupling to the gripping end of the golf club shaft. The end cap fits snugly into the golf club shaft and has the first connector contact and receptacle built into it.

In a fifth exemplary embodiment, the golf club shaft has a conductor opening for receiving the conductor so that the conductor is not compressed between the end of the shaft and the grip.

In a sixth exemplary embodiment, the golf club bag includes a fan electrically connected to the power supply for drying the golfer's hands and a heated pocket with a secondary heating element for warming golf gloves, balls, and/or other items.

In a seventh exemplary embodiment, the heating element is electrically connected to one or more batteries that are received in a battery housing that is mounted in the golf club shaft.

In an eighth exemplary embodiment, the heating element is provided by heat-producing wires or heat strips that are molded or otherwise formed into or attached to-4t3he grip so that the grip and the heating element are a unitary piece.

In a ninth exemplary embodiment, the heating element is provided by a heat-producing rod that is mounted within the hollow golf club shaft for warming the grip through the shaft.

In addition, the ninth exemplary embodiment includes an alternative connector configuration. In this configuration, the first connector includes a center contact and a concentrically arranged ring contact, and the second connector includes a center contact and a peripherally arranged inwardly biased contact. When the golf clubs are inserted into the golf bag compartments, the first connector center contact is electrically engaged by the second connector center contact, and the first connector ring contact is electrically engaged by the second connector inwardly biased contact.

In an alternative form, the present invention comprises a golf club that is manufactured and sold with the grip and heater assembly factory-installed on it. In this way, the golf club is ready for use with golf bags having the cooperating second connectors and power supply.

In another alternative form, the present invention comprises a golf bag that is manufactured and sold with the second connector and the power supply factory-installed in it. In this way, the golf bag is ready for use with golf clubs having the heater assemblies with the heating element and the cooperating first connector.

In yet another embodiment, the present invention comprises a golf club grip that is manufactured with the entire heater assembly or only the heating element factory-installed on or in it. In this way, the grips can be installed by the player's local golf shop on his existing clubs and/or sold as replacement units when the golfer wants his clubs re-gripped.

And in still another alternative form, the present invention comprises a golf bag and a set of grips that are sold together. The golf bag is manufactured with the second connector and the power supply factory-installed in it, and the golf club grips are manufactured with the entire heater assembly or only the heating element factory-installed on or in them. In this way, the grips can be installed by the player's local golf shop on his existing clubs or on new clubs purchased with the bag and grips.

Advantageously, the present invention allows golfers to play the game in drizzling rain, in the early morning dew, earlier and later in the season when it is colder, and in other weather conditions that are less than ideal for playing golf. In particular, the present invention helps keep golf club grips warm and dry when playing in cold and/or wet weather conditions so that players can get a better grip on and a better feel of their clubs. Furthermore, the heating system components are constructed so that they can be easily and cost-effectively used with a player's new or existing golf clubs.

BRIEF DESCRIPTION OF THE DRAWING FIGURES

FIG. 10 is a side cross sectional view of a golf bag according to a second exemplary embodiment of the present invention, showing guides for directing the golf club grips towards the second connectors.

FIG. 11 is a plan view of the golf bag of FIG. 10.

FIG. 12 is a side view of a golf bag according to a third exemplary embodiment, with a portion cutaway to show tapered compartment tubes for directing the golf club grips towards the second connectors.

FIG. 13 is a plan view of the golf bag of FIG. 12.

FIG. 14 is a perspective view of a first connector according to a fourth exemplary embodiment, showing the first connector provided in an end cap for coupling to the golf club shaft.

FIG. 15 is a perspective view of a golf club shaft according to a fifth exemplary embodiment, showing an opening for receiving the first connector conductor.

FIG. 16 is a front view of a golf bag according to a sixth exemplary embodiment, showing an electric fan for drying the golfer's hands.

FIG. 17 is a side view of the golf bag of FIG. 16, showing a heated pocket for warming golf gloves, balls, and/or other items.

FIG. 18 is a cross sectional view of the golf bag taken at line 18—18 of FIG. 17.

DETAILED DESCRIPTION OF EXEMPLARY EMBODIMENTS

Figure 1:
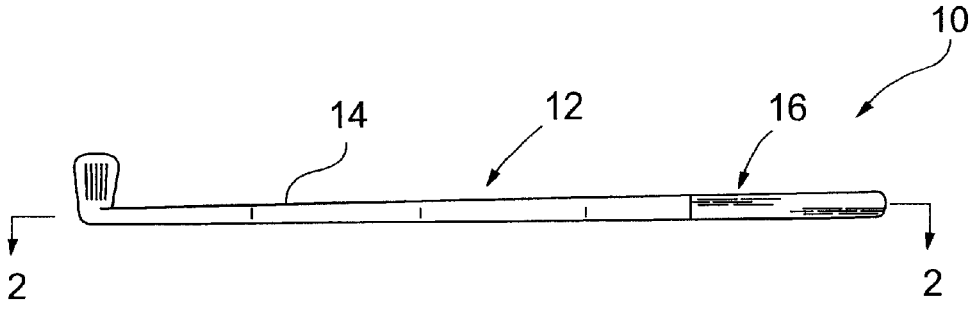
FIG. 1 is a side view of a golf club with a grip having a heater assembly according to a first exemplary embodiment of the present invention.

Referring now in detail to the drawing figures, wherein like reference numerals represent like parts throughout the several views, FIGS. 1–9 illustrate a first exemplary embodiment of the present invention, referred to generally as the golf club grip heating system 10, in use with golf clubs and a golf bag. As shown in FIG. 1, the heating system 10 is used with golf clubs 12 each having a shaft 14 and a grip 16. The shaft 14 may be of a conventional type made of steel, graphite, or another material.

Figure 2:
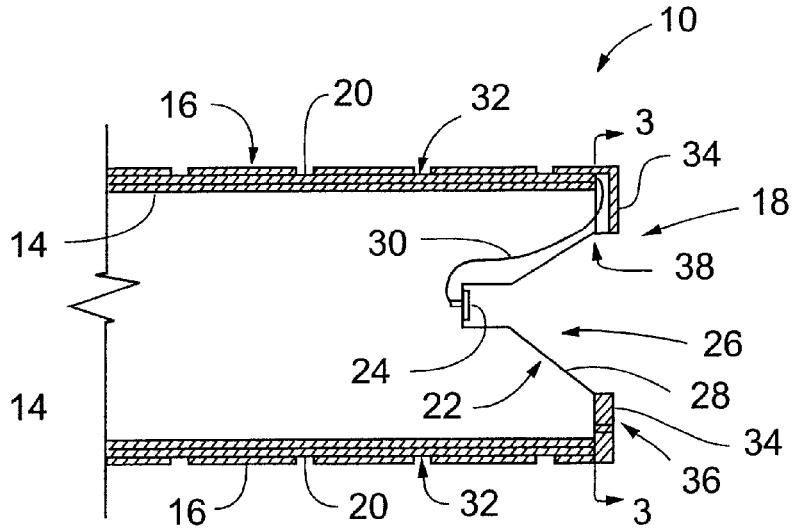
FIG. 2 is a cross sectional view of an end portion of the golf club taken at line 2—2 of FIG. 1, showing a heating element and a first electrical connector of the heater assembly.
Figure 3:
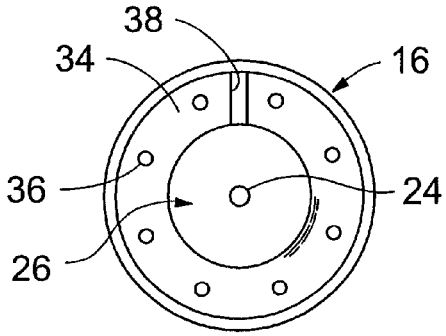
FIG. 3 is an end view of the golf club of FIG. 1.
Figure 4:
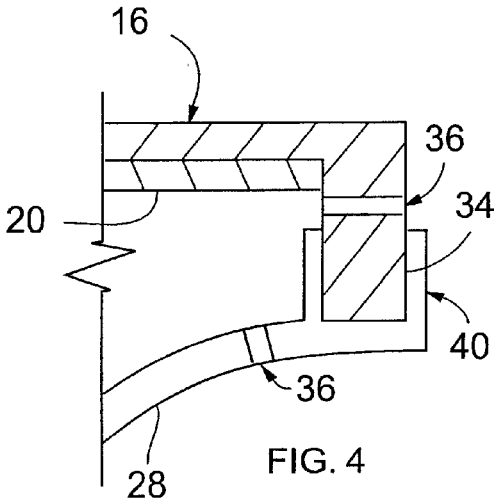
FIG. 4 is a detail of the golf club in the cross sectional view of FIG. 2, showing the connection of the first electrical connector to the grip.

As shown in FIGS. 2–4, the heating system 10 includes, for each golf club 12, a heater assembly 18 that has a heating element 20 and a first electrical connector 22. The heating elements 20 may be provided by electric resistance heat strips, for example, the type commonly used in electric blankets. In a typical commercial embodiment, the heating element 20 is provided by a 35W, 12VDC, heat-producing strip, part no. RU-5765 by HEAT, INC. The heat strip is formed into an adhesive-backed tape that can be wrapped around the golf club shafts 14 so that the grips 16 can then be installed over the tape. Alternatively, the heating elements 20 may be provided by other electrically operated heating elements as are known in the art. And the heating elements 20 can be directly wound onto or otherwise positioned on the shafts, formed into sleeves for inserting into the grips and then sliding over the shafts, molded or otherwise formed into the grips as a unitary piece, or inserted into the hollow shafts for warming the grips through the shafts. In these or other arrangements, when installed on the golf club shafts 14, the heating elements 20 are constructed and positioned to warm and dry the grips 16.

The first electrical connectors 22 are female connectors that are preferably installed at the gripping ends of the golf clubs 12. These female electrical connectors 22 each have a first contact 24 and a receptacle 26 for receiving a mating male connector, which is described in detail below. The receptacles 26 are formed by surfaces such as walls 28 that are preferably tapered to guide the male connectors into electrical contact with the contacts 24 of the female connectors 22. The walls 28 can be tapered so that the receptacle 26 has a conical, frusto-conical, parabolic, or other regular or irregular shape. Also, the first contact 24 is electrically connected to the heating element 20 by at least one conductor 30 such as a wire or a metal strip formed into, attached to, or positioned behind the receptacle walls 28.

It will be understood that although each of the contacts is shown as a single contact, this is done merely for the sake of simplicity. Typically, each of the contacts shown actually will be two contacts arranged concentrically, side-by-side, or otherwise. And, of course, the first electrical connectors 22 can be male connectors and the second electrical connectors can be mating female connectors, or the first electrical connectors and the second electrical connectors can both be male connectors, if so desired.

The grip 16 may be of a conventional type made of an elastomer, leather, or another material selected for providing the desired comfort and gripping characteristics. Although standard grips can be used, certain adaptations are advantageous to obtain the full benefits of the heating system 10. For example, the grips 16 may be provided with vent openings 32 formed through them for transferring heat from the heating elements 20 to the exterior of the grips and to the golfer's hands. These vent openings 32 may be provided by apertures, slots, a combination thereof, or other openings. Alternatively, the grips 16 can be made of or include a material that conducts heat more readily than conventional grips and does not crack and dry out as much over time. For example, the grips 16 can include an internal and/or external layer of such a material, or they can include an array of openings filled with such a material.

In addition, the inward flanges 34 of the grips 16 may be sized to form a larger diameter end hole in the end of the grips than is commonly provided in golf club grips. This larger end hole is sized and shaped to permit inserting the second connector into the tapered-wall receptacle 26. Of course, the receptacle 26 may be provided with a generally cylindrical shape, with non-tapered walls, which can be used with grips with standard-sized end holes. Additionally, because the end hole gets at least to some extent blocked by the first connector 22, the flange 34 and/or the receptacle wall 28 may have one or more secondary end holes 36 that permit air to flow through them. This facilitates sliding the grip 16 onto the shaft 14 during installation and ventilates the inside of the shaft. Furthermore, the flange 34 may have a conductor opening 38, such as a groove, that receives the conductor 30 so that it is not compressed by the gripping end of the golf club shaft 14.

In order to secure the first connector 22 to the grip 16, the walls 28 may have one or more outward flanges 40 extending from them that couple to the grip flanges 34. For example, the outward flanges 40 can be U-shaped for receiving the grip flanges 34 with a snug fit. Alternatively, the outward flanges 40 can be provided by tabs that can be attached to the grip flange by fasteners such as small bolts, screws, rivets, clips, or clamps, by an epoxy or other adherent, or by other fasteners known in the art. In another alternative, the outward flanges 40 can be shaped and sized for attaching directly to the golf club shaft 14.

Figure 5:
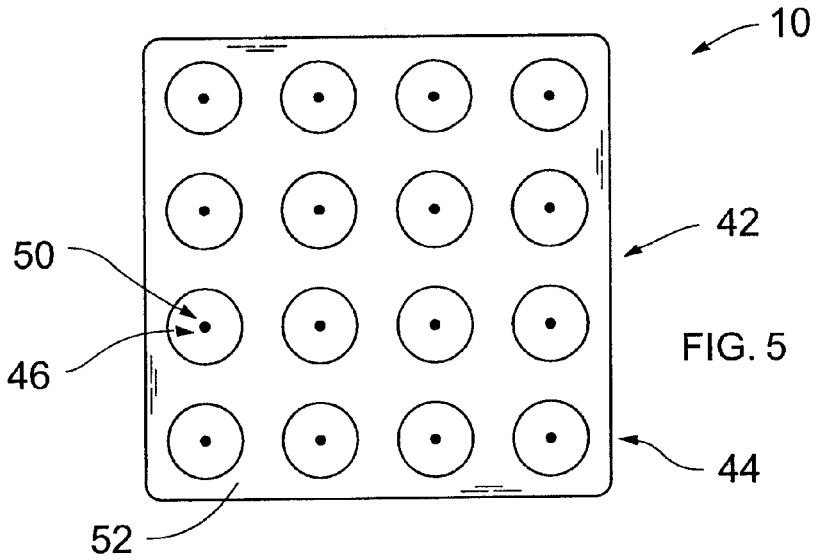
FIG. 5 is a plan view of a golf bag according to the first exemplary embodiment of the present invention, showing a second electrical connector positioned in a dedicated compartment for the golf club.
Figure 6:
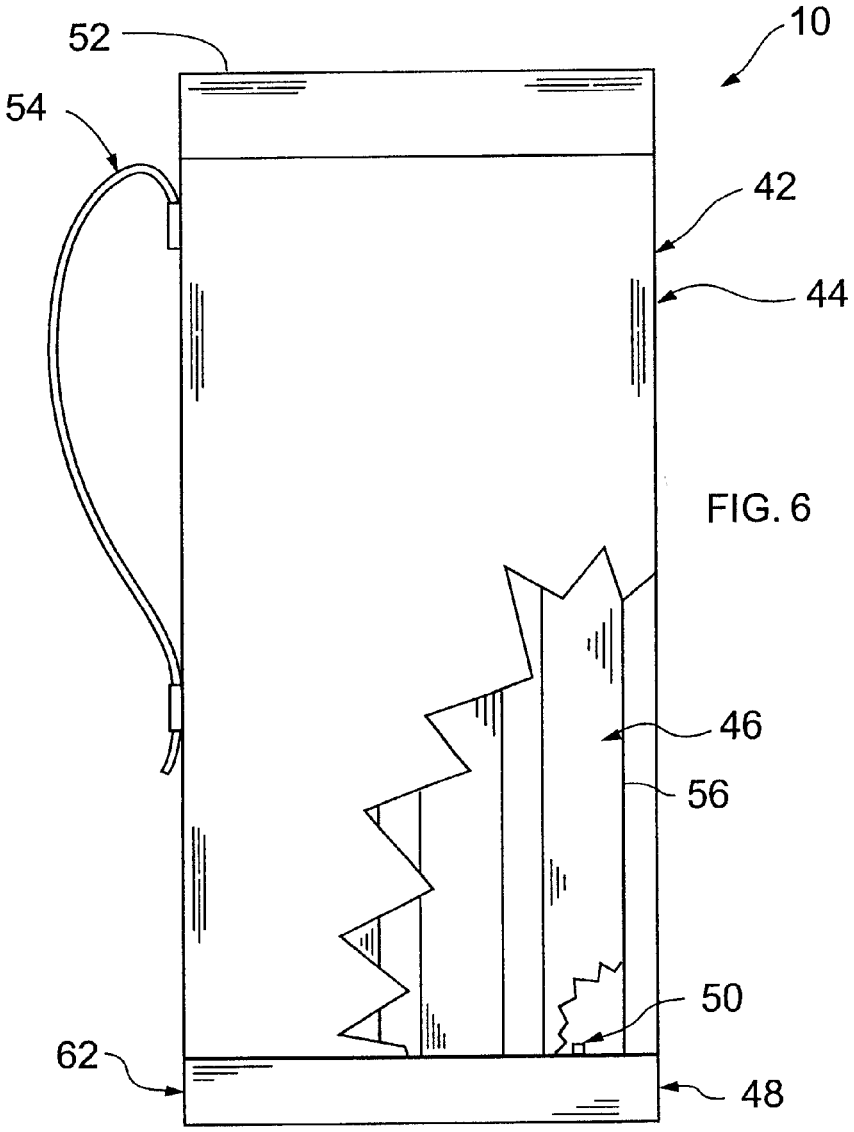
FIG. 6 is a side view of the golf bag of FIG. 5, with a portion cutaway to show the second electrical connector and the dedicated golf club compartment.

Referring now to FIGS. 5 and 6, the heating system 10 additionally includes a golf bag 42 adapted for providing power to the heater assemblies 18. The golf bag 42 includes a shell 44, compartments 46 for receiving the golf clubs 12, a base 48, and the second electrical connectors 50 (mentioned above). The compartments 46 may be provided by tubes with divider walls 56 forming cylindrical, square, polygonal, or other regular or irregular shaped compartments for receiving the golf clubs 12. Additionally, the golf bag 42 may be provided with a top 52 that covers some of the shell 44 but is open at the compartments 46. The base 48 can be detachably or hingedly coupled to the shell 44 by clamps, fasteners, hinges, etc., for at least partially separating the base 48 for accessing the second electrical connectors 50 for cleaning or otherwise maintaining them. Also, the bag 42 may be provided with a carrying handle 54 and/or other components commonly provided on golf bags.

Figure 7:
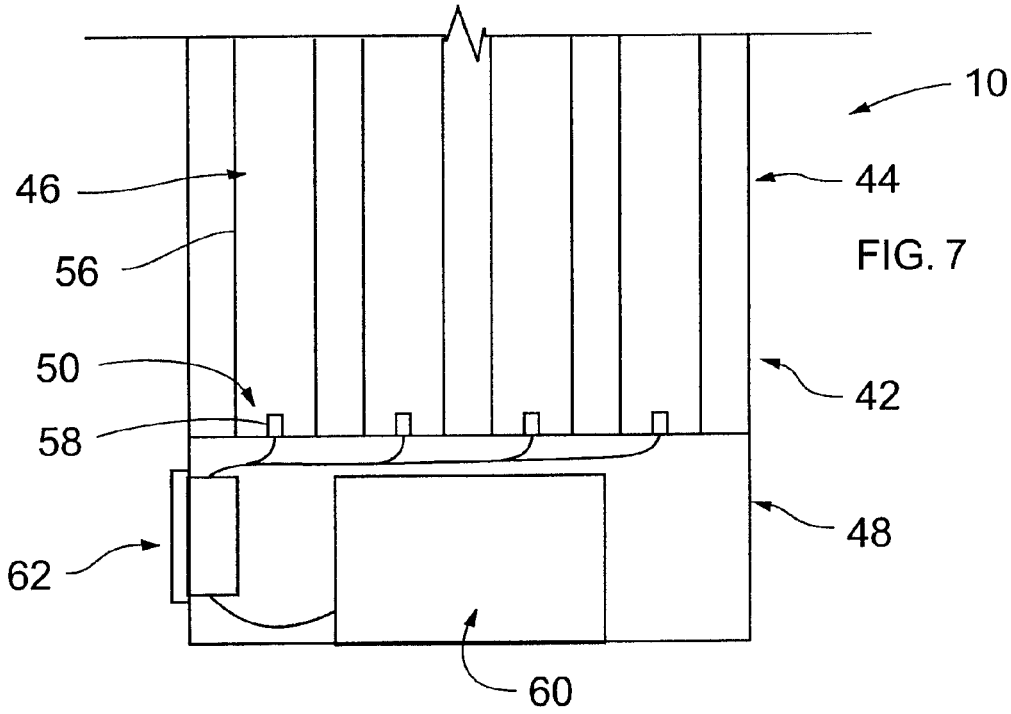
FIG. 7 is a cross sectional detail of the lower part of the golf bag of FIG. 6, showing the second electrical connectors, a power supply, and a control system.
Figure 8:
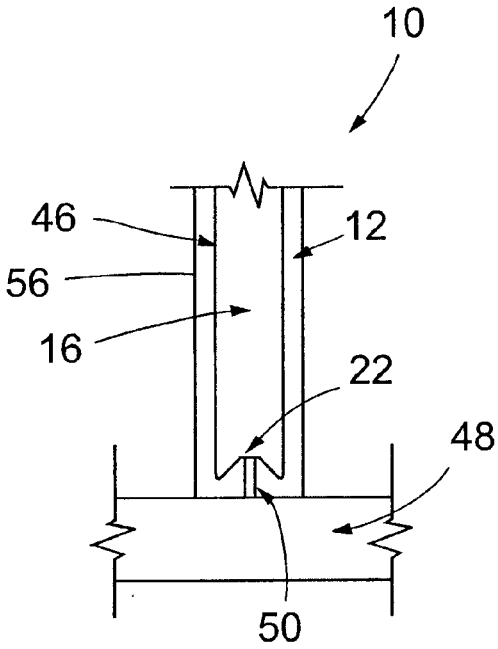
FIG. 8 is a detail of one of the dedicated compartments of the golf bag of FIG. 7, showing the electrical engagement of the first and second electrical connectors.

As mentioned above, the first electrical connectors 22 are positioned at the gripping ends of the golf clubs 12. Referring now to FIGS. 7 and 8, the second electrical connectors 50 are configured to electrically connect to the first electrical connectors 22 when the golf clubs 12 are inserted into the golf bag compartments 46 with their gripping ends down. For example, the second electrical connectors 50 may be male connectors each with a second electric contact 58 extending from the base 48 and into the shell 44, with one of the connectors 50 in each of the compartments 46. Alternatively, the second contact 58 can be positioned in a recess in the base 48, with the recess sized and shaped for receiving the gripping end of the golf club 12 and guiding it towards the second electrical connector 50. In this way, when the golf clubs 12 are inserted into the golf bag 42, the first contact 24 of the first electrical connector 22 of each golf club is electrically engaged by the second contact 58 of the corresponding second electrical connector 50 of the golf bag 42.

Figure 9:
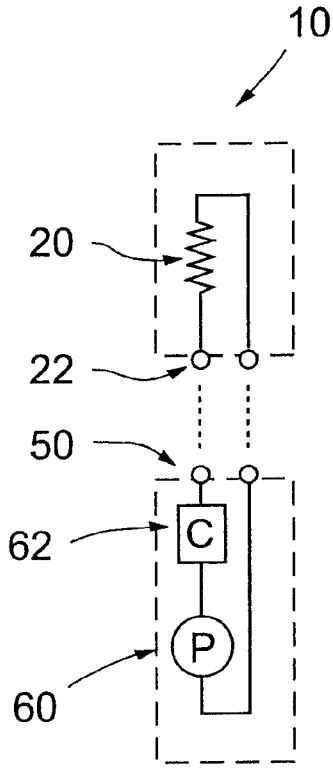
FIG. 9 is a schematic block diagram of the electrical components of the heating system of the first exemplary embodiment of FIG. 1.

Referring now to FIGS. 7 and 9, the golf club bag 42 includes an electric power supply 60 and electric controls 62 electrically connected to the electric power supply. The power supply 60 and the controls 62 may be mounted in the base 48 of the golf bag 42 for ease of manufacture and for stability in using the bag. Alternatively, the controls 62 can be mounted adjacent the top of the bag 42 for ease of access by the golfer when playing the game.

The power supply 60 may be provided by a battery housing for one or more rechargeable or disposable batteries. Alternatively, the power supply 60 may include solar cells or other conventional sources of electric power. The controls 62 may include "on/off" (and "high/low") controls such as pushbuttons, toggles, knobs, or dials, "on" and "low battery" indicator lights, and/or timer controls for automatically turning off the heater assembly after a selected period of time. In addition, the controls 62 may include a thermostat for selecting a specific temperature best suited to the player and the current weather conditions.

Where the power supply 60 includes rechargeable batteries, then in addition the controls 62 include an AC/DC transformer and an electric cord for plugging into a standard 110VAC outlet. The electric cord is constructed to retract into a well in the bag 42, unplug from a jack on the bag, or to otherwise be selectively extended from or connected to the bag for recharging the battery. Alternatively, a cradle can be provided for receiving the base 48, with the base having contacts that electrically engage contacts on the cradle for recharging the battery.

To use the heating system 10, the golf clubs 12 are inserted grip-first into the compartments 46 of the golf bag 42 so that the first electrical connector 22 and the second electrical connector 50 electrically engage to energize the heating element 20. While the golf clubs 12 are in the bag 42, the energized heating elements 20 help keep the grips 16 warm and dry. When the golfer takes out one of the clubs 12 from the bag 42, that club's grip 16 is warm and dry and ready for use. After use, the grip 16 may have gotten slightly wet and cooler, but inserting the club 12 back into the bag 42 will again warm and dry the grip so that it is ready for the next time it is needed.

FIGS. 10 and 11 show a golf bag 142 according to a second exemplary embodiment of the present invention that is similar to that of the first exemplary embodiment described above. In this embodiment, the compartments 146 of the golf club bag 142 include guides 164 that are mounted to the divider walls 156 to urge the golf clubs into alignment with the corresponding second electrical connectors 150.

FIGS. 12 and 13 show a golf bag 242 according to a third exemplary embodiment that is similar to that if the first exemplary embodiment described above. In this embodiment, the compartments 246 of the golf club bag 242 have divider walls 256 that are tapered to form smaller cross-sectional compartments 266 adjacent the bag base 248 than at the bag top 252 to urge to the golf clubs into alignment with the corresponding second electrical connectors 250.

FIG. 14 shows the gripping end of a golf club shaft 314 with a heater assembly 318 according to a fourth exemplary embodiment that is similar to that of the first exemplary embodiment described above. In this embodiment, the heater assembly 318 includes an end cap 370 that can be coupled to the gripping end of the golf club shaft 314, with the first electrical connector 322 being part of and extending from the end cap. The end cap 370 has an outer portion 372 that extends from the shaft 314 and an inner portion 374 that is received in the shaft with a snug fit. The outer portion 372 has a conductor opening 338 for receiving the conductor 330 so that the conductor is not compressed by the end of the shaft 314.

FIG. 15 shows the gripping end of a golf club shaft 414 according to a fifth exemplary embodiment that is similar to that of the first exemplary embodiment described above. In this embodiment, the golf club shaft 414 has a conductor opening 438 for receiving the conductor so that the conductor is not compressed between the end of the shaft and the grip.

FIGS. 16–18 show a golf bag 542 according to a sixth exemplary embodiment that is similar to that of the first exemplary embodiment described above. In this embodiment, the golf club bag 542 additionally includes a fan 576 for drying the golfer's hands. The fan 576 is mounted to the bag shell 544 and electrically connected to the power supply 560 by a conductor 578 routed through a channel 580 in the shell.

In addition, the sixth embodiment includes a heated pocket 582 for warming golf gloves, balls, and/or other items. The pocket 582 has a secondary heating element 584 that lines it and/or divides it into compartments, and that is electrically connected to the power supply 560 by a conductor 586. Also, the pocket 582 includes an access opening 588 with a zipper or other closure mechanism. In this embodiment, the controls include conventional components for operating the fan 576 and the secondary heating element 584.

Figure 19:
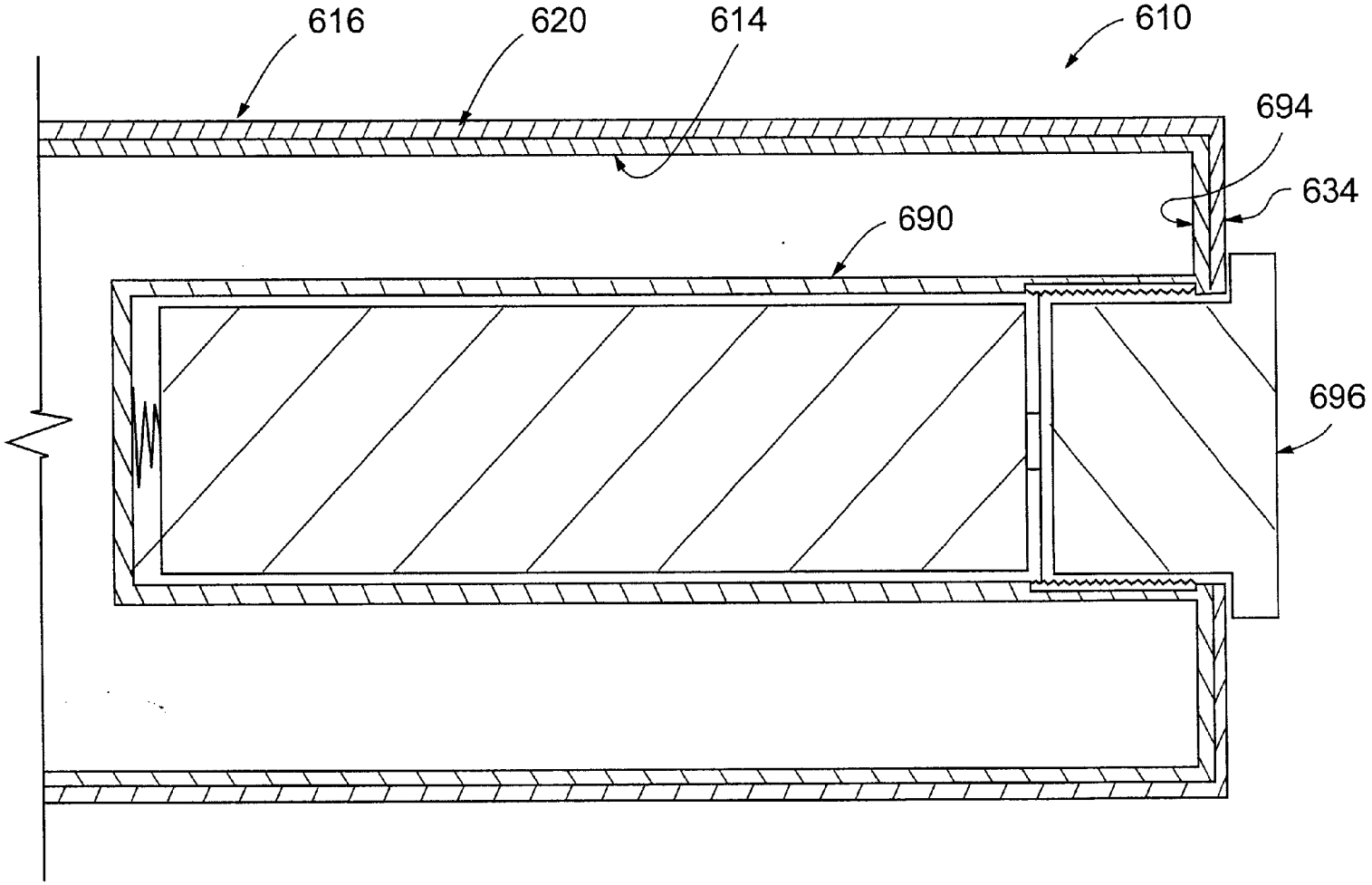
FIG. 19 is a cross sectional detail of a heating system according to a seventh exemplary embodiment, showing a heating element and one or more batteries mounted in the golf club shaft.

FIG. 19 shows a heating system 610 according to a seventh exemplary embodiment of the present invention. In this embodiment, the heating element 620 is electrically connected to one or more batteries 692 that are receivable in a battery housing 690 that is positioned in the golf club shaft 614. The battery housing 690 may be provided with an outward flange 694 that extends into a gap between the heating element 620 and the grip flange 634 to secure the battery housing in place. Of course, the battery housing 690 can be secured in place by other structures known in the art. Also, the battery housing 690 may include an end cap 696 that screws into, is hingedly attached to, or is otherwise coupled to the battery housing so that the batteries can be replaced or accessed for recharging. It will be understood that this embodiment can be provided with a rechargeable battery in the shaft that electrically connects and is recharged by the power supply of the embodiments described above.

Figure 20:
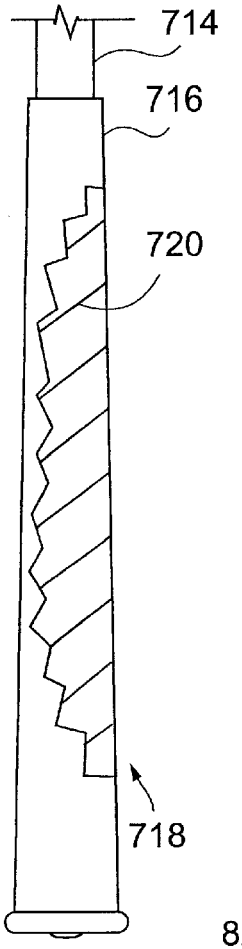
FIG. 20 is a side view of a portion of a golf club according to an eighth exemplary embodiment, with part of the grip cutaway to show the heating element formed integrally into the grip.

FIG. 20 shows the gripping end of a golf club shaft 714 with a heater assembly 718 according to an eighth exemplary embodiment that is similar to that of the first exemplary embodiment described above. In this embodiment, the heating element 720 is provided by heat-producing wires wound into a coil and molded into the grip 716. In a typical commercial embodiment, the heating element wires 720 are provided by 7 Ohm resistant wire, part no. ENV32002 by BH THERMAL CORP. of Columbus, Ohio. Alternatively, the heating elements 720 can be provided by electric resistance heat strips molded into the grip 716, for example, the 35W, 12VDC, heat-producing strips of the first exemplary embodiment.

Figure 21:
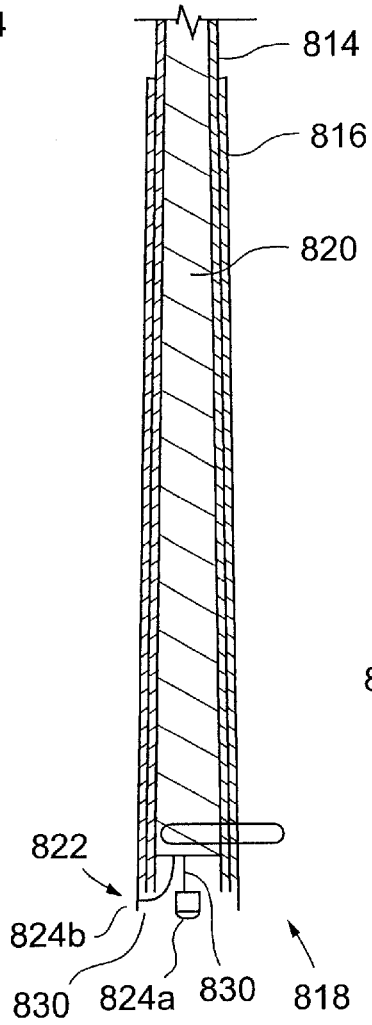
FIG. 21 is a cross sectional view of a portion of a golf club according to a ninth exemplary embodiment, showing the heating element mounted within the hollow golf club shaft and the first connector including center and concentric contacts.

FIG. 21 shows the gripping end of a golf club shaft 814 with a heater assembly 818 according to a ninth exemplary embodiment that is similar to that of the first exemplary embodiment described above. In this embodiment, the heating element 820 is provided by a heat-producing rod inserted into the hollow shaft 814 for warming the grip 816 through the shaft. In a typical commercial embodiment, the heating element rod 820 is provided by a ½ inch by 9 inch, 35W, 12VDC, C-Series heating rod, by GAUNER CO., INC. This configuration works with shafts 814 made of steel, graphite, or other materials.

Figure 22:
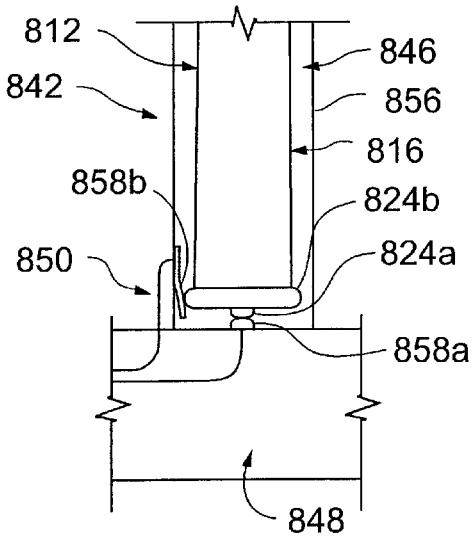
FIG. 22 is a detail of a dedicated compartment of a golf bag according to the ninth exemplary embodiment of FIG. 21, showing the first connector electrically engaging the second connector.

Referring to FIGS. 21 and 22, there is shown an alternative connector configuration. In this configuration, the first connector 822 includes a center contact 824*a* and a concentrically arranged ring contact 824*b*. The first contacts 824*a* and 824*b* are separated from each other and electrically connected to the heating element 820 by conductors 830 such as wires or metal strips. The first contacts 824*a* and 824*b* can be provided together in an end cap that plugs into the end of the shaft 814 or that is integrally formed with the grip 816 in a unitary piece. In addition, the second connector 850 includes a center contact 858*a* and a peripherally arranged inwardly biased contact 858*b*. The second contacts 858*a* and 858*b* are separated from each other and electrically connected to the power supply (not shown) by conductors such as wires or metal strips. The inwardly biased contact 858*b* can be provided by, for example, a bent strip of metal mounted to the divider wall 856 or to the base 848 that biases the grip towards the center of the compartment 846. Multiple contacts 858*b* can be provided, if desired. In this way, when the golf clubs 812 are inserted with their gripping ends down into the compartments 846 of the golf bag 842, the second electrical connectors 850 are electrically engaged by the first electrical connectors 822.

It will be understood that other connector configurations can be suitably employed. In one alternative configuration, the connectors are provided by inductive coils covered by a layer of plastic or other non-conducting material. The inductive coils transfer electricity by induction and do not actually contact each other. Such inductive energy transfer systems are used are in rechargeable toothbrushes made by BRAUN of Kronberg, Germany, and a person of ordinary skill in the art will understand how to adapt such a system to the present invention. This configuration provides increased safety and reliability in wet conditions because the inductive coil connectors are not exposed. And because grass and dirt do not get as easily into the connectors, they do not need to be cleaned or otherwise maintained.

In another embodiment of the invention, the golf clubs are manufactured and sold with the grips and heater assemblies factory-installed on them, so the golf clubs are ready for use with golf bags having the cooperating second connectors and power supply. In yet another embodiment, the golf club grips are manufactured with the heater assemblies factory-installed on them, and sold with a golf bag having the cooperating second connectors and power supply, with golf clubs suitable for installation thereon, or separately. In still another embodiment, the heater assemblies are made and sold separately from the golf club and grip, for new or retrofit installation by the end user or his local golf shop.

In addition, the present invention includes a method of installing grip heater assemblies on new golf clubs or retrofitting them on used clubs. The method includes the steps of providing a heater assembly including a heating element and a first electrical connector, positioning the heating element on or in the shaft of the golf club, positioning the grip on the shaft of the golf club, and positioning the first electrical connector at the gripping end of the golf club shaft so that when the club is inserted into a golf bag with at least one second electrical connector and an electric power supply, the first electrical connector electrically engages the second electrical connector. Where the heating element and the golf club grip are provided as a unitary piece, they are mounted to the golf club together in a single step.

Accordingly, the golf club grip heating system of the present invention provides a number of advantages to golfers. The heating system includes the specially adapted heating elements that help keep the golf club grips warm and dry when playing in cold and/or wet weather conditions. And the heating system includes electrical components built into the specially adapted golf bag that reliably powers the heating elements. Furthermore, the heating system components are constructed so that they can be provided to players in a variety of ways, such as the specially adapted golf bag with the specially adapted grips, the grips by themselves for replacement purposes, golf clubs with the specially adapted grips installed on them, etc.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be unnecessarily limiting of the claimed invention. In addition, as used in the specification including the appended claims, the singular forms "a," "an," and "the" include the plural, plural forms include the singular, and reference to a particular numerical value includes at least that particular value, unless the context clearly dictates otherwise. Furthermore, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as set forth in the following claims.

What is claimed is:

1. A heating system for grips for golf clubs, the heating system comprising:

a plurality of heater assemblies adapted for positioning on the golf clubs adjacent to the grips, each of the heater assemblies comprising a heating element and a first electrical connector electrically connected to the heating element; and a golf club bag including an electric power supply and a plurality of second electrical connectors electrically connected to the power supply, wherein the second electrical connectors are configured to electrically engage the first electrical connectors to energize the heating elements when the golf clubs are positioned in the golf bag.

2. The golf club grip heating system of claim 1, wherein each of the heating elements comprises an electric resistance heat strip, heating rod, or wire.

3. The golf club grip heating system of claim 1, wherein the golf club has a shaft, and wherein each of the heating elements is adapted to be positioned between the corresponding golf club shaft and the grip, to be positioned within the golf club shaft, or to be formed into the grip as a unitary piece.

4. The golf club grip heating system of claim 1, wherein each of the heater assemblies includes at least one conductor connecting the first electrical connector to the heating element, and further comprising an opening defined in the grip or the first connector of each of the golf clubs that is configured to receive the corresponding conductor therethrough.

5. The golf club grip heating system of claim 1, wherein each of the heater assemblies includes at least one end cap adapted to be coupled to one of the golf clubs, wherein the corresponding first electrical connector extends from and is part of the end cap.

6. The golf club grip heating system of claim 1, wherein the first or the second electrical connectors are female connectors and the other of the first and the second electrical connectors are male connectors, wherein each of the female connectors comprises a receptacle with tapered walls for receiving one of the male connectors.

7. The golf club grip heating system of claim 1, wherein each of the first electrical connectors comprises a center contact and a concentric ring contact, and each of the second electrical connectors comprises a center contact and a peripheral inwardly biased contact, wherein when the clubs are inserted into the bag the first center contact electrically engages the second center contact and the first concentric ring contact electrically engages the second peripheral inwardly biased contact.

8. The golf club grip heating system of claim 1, wherein the first electrical connectors are positionable at a gripping end of the golf clubs, and the golf club bag includes a shell for receiving the golf clubs and a base with the second electrical connectors coupled thereto and extending into the shell.

9. The golf club grip heating system of claim 1, wherein the golf club bag includes compartments for receiving the golf clubs, and at least one of the second electrical connectors is disposed in at least one of the compartments.

10. The golf club grip heating system of claim 9, wherein the golf club bag compartments are formed by divider walls, and further comprising guides coupled to the divider walls and configured to urge the golf clubs into alignment with the corresponding second electrical connectors.

11. The golf club grip heating system of claim 9, wherein the golf club bag shell has a top and the compartments are formed by divider walls that are tapered to form smaller cross-sectional compartments adjacent the base than adjacent the top to urge the golf clubs into alignment with the corresponding second electrical connectors.

12. A heater assembly for a grip for a golf club and for use with a golf club bag having a plurality of second electrical connectors electrically connected to an electric power supply, the heater assembly comprising:

a heating element adapted for installing on the golf club adjacent the grip; and a first electrical connector electrically connected to the heating element, the first electrical connector adapted for electrically engaging one of the second electrical connectors to energize the heating element when the golf clubs are positioned in the golf bag.

13. The heater assembly of claim 12, wherein the heating element comprises an electric resistance heat strip, heating rod, or wire.

14. The heater assembly of claim 12, wherein the golf club has a shaft and wherein the heating element is adapted to be positioned between the golf club shaft and the grip, to be positioned within the golf club shaft, or to be formed into the grip as a unitary piece.

15. The heater assembly of claim 12, wherein the first electrical connector includes at least one conductor connected to the heating element, and further comprising an opening defined in the grip or the first connector that is configured to receive the conductor therethrough.

16. The heater assembly of claim 12, further comprising at least one end cap adapted to be coupled to the golf club, wherein the first electrical connector extends from and is part of the end cap.

17. The heater assembly of claim 12, wherein the first electrical connector is a female connector comprising a contact and a receptacle with tapered walls for receiving and guiding one of the second connectors into engagement with the contact.

18. The heater assembly of claim 12, wherein the first electrical connector comprises a center contact and a concentric ring contact for being received and guided into engagement with one of the second connectors.

19. The heater assembly of claim 12 in combination with the grip.

20. The heater assembly of claim 19 in combination with the golf club.

21. A golf club bag for use with heater assemblies for grips for golf clubs, the heater assemblies each comprising a heating element electrically connected to a first electrical connector, the golf club bag comprising:

an electric power supply mounted in or to the golf club bag; and a plurality of second electrical connectors electrically connected to the power supply and configured to electrically engage the first electrical connectors to energize the heating elements when the golf clubs are positioned in the golf bag.

22. The golf club bag of claim 21, further comprising a shell for receiving the golf clubs and a base with the second electrical connectors coupled thereto and extending into the shell.

23. The golf club bag of claim 21, further comprising compartments for receiving the golf clubs, wherein at least one of the second electrical connectors is disposed in at least one of the compartments.

24. The golf club bag of claim 23, wherein the compartments are formed by divider walls, and further comprising guides coupled to the divider walls and configured to urge the golf clubs into alignment with the corresponding second electrical connectors.

25. The golf club bag of claim 23, wherein the shell has a top and the compartments are formed by divider walls that are tapered to form smaller cross-sectional compartments adjacent the base than adjacent the top to urge to the golf clubs into alignment with the corresponding second electrical connectors.

26. The golf club bag of claim 21, further comprising electric controls electrically connected to the electric power supply.

27. The golf club bag of claim 21, wherein the golf club bag includes at least one pocket, and further comprising a secondary heater assembly disposed in the pocket and electrically connected to the power supply.

28. The golf club bag of claim 21 in combination with the heater assemblies.

29. The golf club bag of claim 28 in combination with the grips.

30. The golf club bag of claim 29 in combination with the golf clubs.

31. A heating system for a grip of a golf club, comprising:

a heating element adapted for mounting to the golf club adjacent to the grip;

a housing for a portable electric power supply adapted for mounting within the golf club and electrically connecting to and energizing the heating element, wherein the housing has an outward flange that extends into a gap between the heating element and a flange on the grip to secure the housing in place.

32. The heating system of claim 31 in combination with the grip.

33. The heating system of claim 32 in combination with the golf club.

34. A method of modifying a golf club to heat a golf club grip when used with a golf club bag having second electrical connectors electrically connected to an electric power supply, the method comprising:

providing a heater assembly including a heating element and a first electrical connector electrically connected to the heating element;

mounting the heating element to the golf club;

mounting the grip to the golf club; and mounting the first electrical connector to the golf club or to the grip so that when the club is inserted into the golf club bag the first electrical connector electrically engages the second electrical connector to energize the heating element.

35. The method of claim 34, wherein the heating element and the golf club grip are provided as a unitary piece, and wherein the steps of mounting the heating element to the golf club and mounting the grip to the golf club are accomplished together in one step.

36. A heating system for a grip for a golf club, the heating system comprising:

at least one heating element adapted for positioning adjacent to the grip; and a golf club bag including an electric power supply, wherein the heating system is configured to electrically connect the heating element to the electric power supply to energize the heating element when the golf club is positioned in the golf bag.

* * * * *